US008733902B2

(12) United States Patent
Chung et al.

(10) Patent No.: US 8,733,902 B2
(45) Date of Patent: May 27, 2014

(54) PRINTHEAD FEED SLOT RIBS

(75) Inventors: Bradley D. Chung, Corvallis, OR (US); Manish Giri, Corvallis, OR (US); Emmet Whittaker, Corvallis, OR (US); Sean P McClelland, Corvallis, OR (US); Andrew Phillips, Corvallis, OR (US); Benjamin Clark, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 912 days.

(21) Appl. No.: 12/934,708

(22) PCT Filed: May 6, 2008

(86) PCT No.: PCT/US2008/062798

§ 371 (c)(1),
(2), (4) Date: Sep. 27, 2010

(87) PCT Pub. No.: WO2009/136915

PCT Pub. Date: Nov. 12, 2009

(65) Prior Publication Data

US 2011/0019210 A1 Jan. 27, 2011

(51) Int. Cl.

| | |
|---|---|
| ***B41J 2/05*** | (2006.01) |
| ***B41J 2/16*** | (2006.01) |
| *B41J 2/14* | (2006.01) |

(52) U.S. Cl.

CPC ..... *B41J 2/1603* (2013.01); *B41J 2/1642* (2013.01); *B41J 2/1404* (2013.01)

USPC ..... 347/65

(58) Field of Classification Search

CPC .... B41J 2/1404; B41J 2/14129; B41J 2/1603; B41J 2/1642

USPC ..... 347/20, 54, 63, 65; 358/1.8

See application file for complete search history.

(56) References Cited

U.S. PATENT DOCUMENTS

| | | | |
|---|---|---|---|
| 5,105,429 | A | 4/1992 | Mundinger et al. |
| 5,317,346 | A | 5/1994 | Garcia |
| 5,608,436 | A | 3/1997 | Baughman et al. |
| 5,841,452 | A | 11/1998 | Silverbrook |
| 6,000,787 | A | 12/1999 | Weber et al. |
| 6,328,428 | B1 | 12/2001 | Keefe et al. |
| 6,350,023 | B1 | 2/2002 | Silverbrook |

(Continued)

FOREIGN PATENT DOCUMENTS

| | | |
|---|---|---|
| EP | 0760287 | 3/1997 |
| EP | 0760287 A2 | 3/1997 |

(Continued)

OTHER PUBLICATIONS

Supplementary European Search Report for Application No. EP08755093. Report issued Jul. 22, 2011.

(Continued)

*Primary Examiner* — An Do

(57) ABSTRACT

A print head (24, 224, 424, 624) includes a layer (36, 236) which at least partially forms firing chambers (42, 242) and ribs (46, 246, 646) in contact with opposing side walls of a fluid feed slot (40, 240) while extending from a first side wall to a second opposite side wall within the fluid feed slot (40, 240).

20 Claims, 9 Drawing Sheets

(56) References Cited

U.S. PATENT DOCUMENTS

| | | | | |
|---|---|---|---|---|
| 6,474,794 | B1 | 11/2002 | Anagnostopoulos et al. | |
| 6,540,337 | B1 | 4/2003 | Pollard | |
| 6,672,712 | B1 | 1/2004 | Donaldson et al. | |
| 6,830,319 | B2 | 12/2004 | Harajiri et al. | |
| 6,880,246 | B2 | 4/2005 | Horvath et al. | |
| 6,930,055 | B1 | 8/2005 | Bhowmik | |
| 7,040,735 | B2 | 5/2006 | Donaldson et al. | |
| 7,083,268 | B2 | 8/2006 | Obert et al. | |
| 7,437,820 | B2 | 10/2008 | Sexton et al. | |
| 8,262,204 | B2 * | 9/2012 | Braun et al. | 347/85 |
| 2002/0153346 | A1 | 10/2002 | Kawamura et al. | |
| 2003/0005883 | A1 | 1/2003 | Feinn et al. | |
| 2003/0052947 | A1 | 3/2003 | Lin et al. | |
| 2003/0058309 | A1 | 3/2003 | Haluzak et al. | |
| 2003/0193550 | A1 | 10/2003 | Harajiri | |
| 2004/0017438 | A1 | 1/2004 | Pollard | |
| 2004/0055145 | A1 | 3/2004 | Buswell | |
| 2004/0233254 | A1 | 11/2004 | Kim | |
| 2005/0036004 | A1 | 2/2005 | Horn et al. | |
| 2007/0176990 | A1 | 8/2007 | Urayama et al. | |
| 2011/0207328 | A1 * | 8/2011 | Speakman | 438/694 |

FOREIGN PATENT DOCUMENTS

| | | | |
|---|---|---|---|
| EP | 0911168 | A2 | 4/1999 |
| EP | 0924077 | A2 | 6/1999 |
| JP | 4-118246 | | 2/1992 |

OTHER PUBLICATIONS

ISA Search Report and Written Opinion.

* cited by examiner

PRINTHEAD FEED SLOT RIBS

BACKGROUND

Print heads sometimes include dies having feed slots through which fluid is delivered to fluid firing chambers. Reducing slot pitches and increasing die length increases the fragility of the die.

DETAILED DESCRIPTION OF THE EXAMPLE EMBODIMENTS

Figure 1:
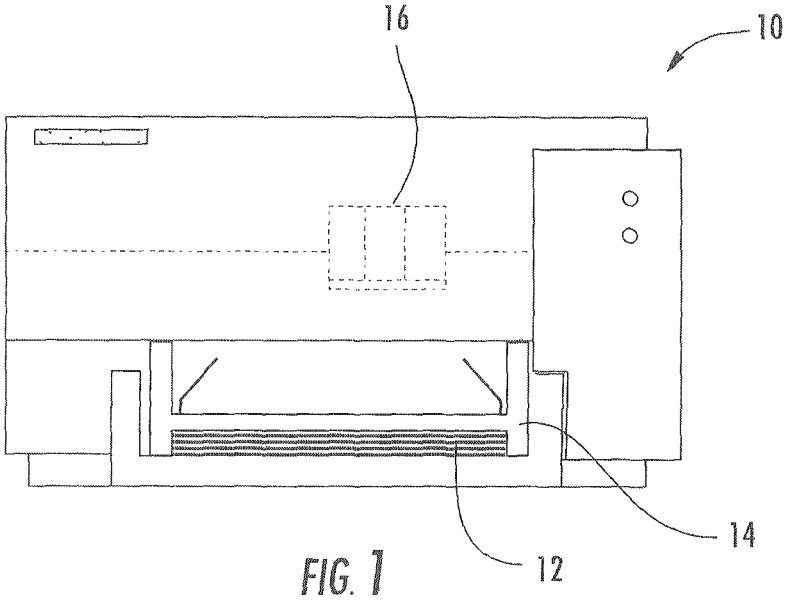
FIG. 1 is a front elevational view of a printer according to an example embodiment.

FIG. 1 illustrates one example of a printing device 10 according to an example embodiment. Printing device 10 is configured to print or deposit ink or other fluid onto a print media 12, such as sheets of paper or other material. Printing device 10 includes a media feed 14 and one or more print cartridges 16. Media feed 14 drives or moves media 12 relative to cartridges 16 which eject ink or fluid onto the medium. In the example illustrated, cartridges 16 are driven or scanned transversely across media 12 during printing. In other embodiment, cartridges 16 maybe stationary and may extend substantially across a transverse width the media 12.

Although cartridge 16 is illustrated as a cartridge configured to be removably mounted to or within printing device 10, in other embodiments, cartridges 16 may comprise one or more structures which are a substantially permanent part of printing device 10 and which are not removable. Although printing device 10 is illustrated as a front loading and front discharging desktop printer, in other embodiments, printing device 10 may have other configurations and may comprise other printing devices where printing device 10 prints or ejects a controlled pattern, image or layout and the like of fluid onto a surface. Examples of other such printing devices include, but are not limited to, facsimile machines, photocopiers, multifunction devices or other devices which print or eject fluid.

As will be described hereinafter, print cartridges 16 include print heads that have fluid firing chambers formed from a layer that also forms ribs that extend within and span a fluid feed slot that supplies fluid to the firing chambers. Such ribs strengthen the die and reduce fractures in the die during detaping by an end-user.

Figure 2:
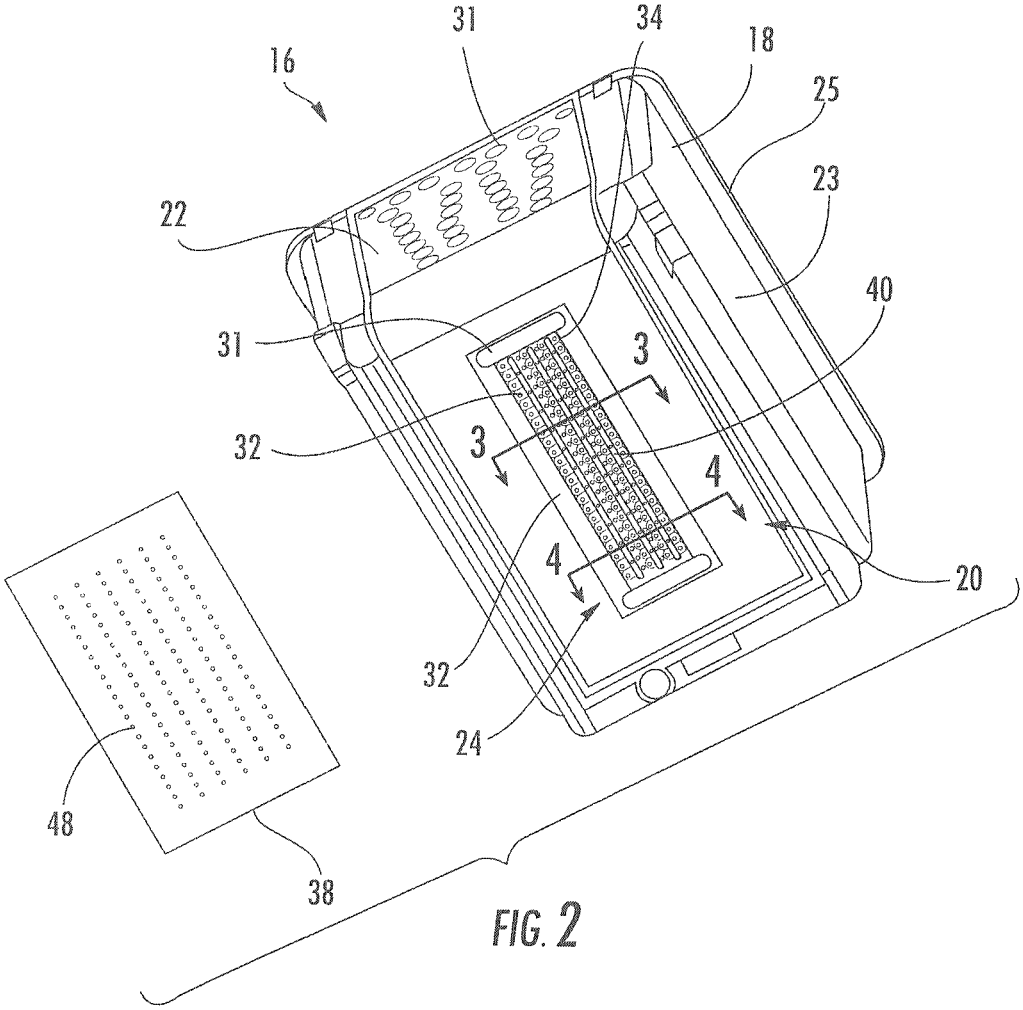
FIG. 2 is an exploded bottom perspective view of a print cartridge of the printer of FIG. 1 according to an example embodiment.

FIGS. 2-5 illustrates one of cartridges 16 in more detail. As shown by FIG. 2, cartridge 16 includes fluid reservoir 18 and head assembly 20 including flexible circuit 22 and print head 24. Fluid reservoir 18 comprises one or more structures configured to supply fluid or ink to head assembly 20. In one embodiment, fluid reservoir 18 includes a body 23 and a lid 25 which form one or more internal fluid chambers that contain fluid, such as ink, which is discharged through slots or openings to head assembly 20. In one embodiment, the one or more internal fluid chambers may additionally include a capillary medium (not shown) for exerting a capillary force on the printing fluid to reduce the likelihood of the printing fluid leaking. In one embodiment, each internal chamber of fluid reservoir 18 may further include an internal standpipe (not shown) and a filter across the internal standpipe. In yet another embodiment, fluid reservoir 18 may have other configurations. For example, although fluid reservoir 18 is illustrated as including a self-contained supply of one or more types of fluid or inks, in other embodiments, fluid reservoir 18 may be configured to receive fluid or ink from an off-axis of fluid supply via one or more conduits or tubes.

Figure 3:
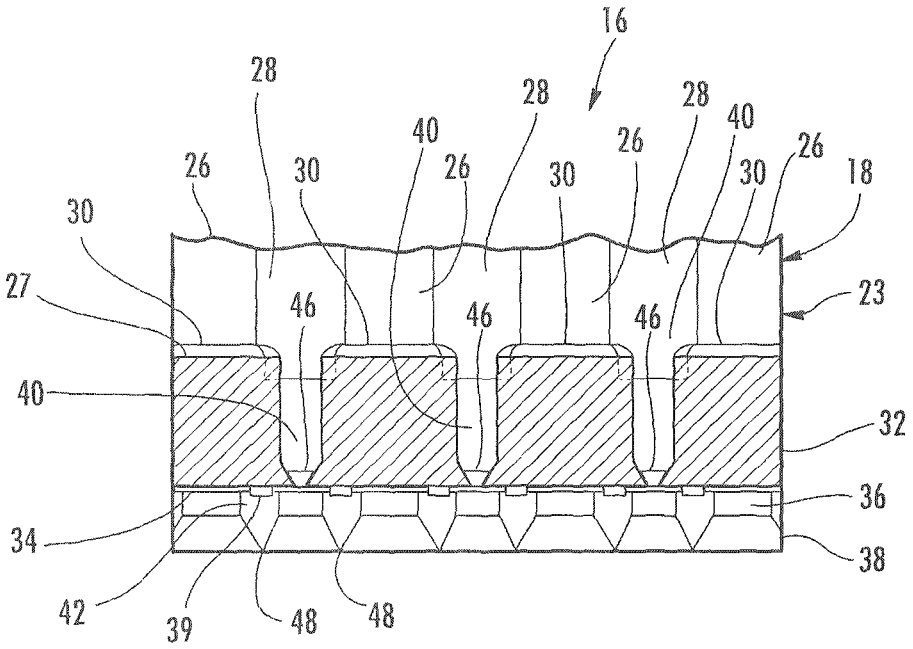
FIG. 3 is a sectional view of the cartridge of FIG. 2 taken along line 3-3 according to an example embodiment.
Figure 4:
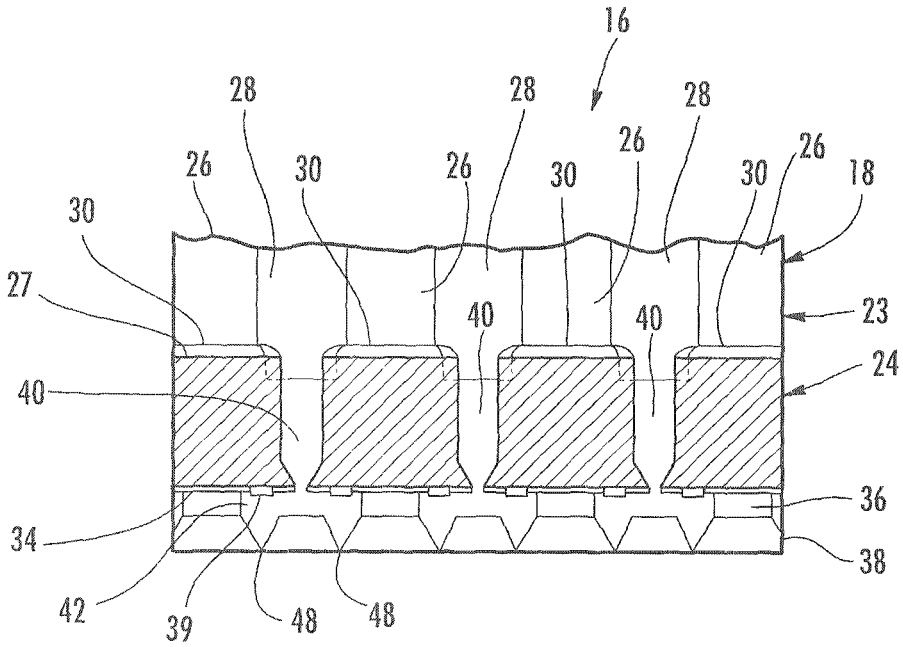
FIG. 4 is a sectional view of the cartridge of FIG. 2 taken along line 4-4 according to an example embodiment.

As shown by FIGS. 3 and 4, body 23 of reservoir 18 includes inter-posers or headlands 26. Headlands 26 comprise those structures or portions of body 23 which are connected to print head 24 so as to fluidly seal one or more chambers of reservoir 18 to side 27 of print head 24. In the example illustrated, headlands 26 connect each of the three separate fluid containing chambers 28 to each of the three slots of print head 24. For example, in one embodiment, reservoir 18 may include three separate stand pipes which deliver fluid to each of the three slots. In one embodiment, each of the three separate chambers may include a distinct type of fluid, such as a distinct color of fluid or ink. In other embodiments, body 23 of reservoir 18 may include a greater or fewer number of such headlands 26 depending upon the number of slots in print head which are to receive different fluids from different chambers in reservoir 18.

In the example illustrated, side 27 of die 30 is adhesively bonded to body 23 by an adhesive 30. In one embodiment, adhesive 30 comprises a glue or other fluid adhesive. In other embodiments, headlands 26 of reservoir 18 may be sealed and joined to die 24 in other fashions.

Head assembly 20 comprises a mechanism coupled to reservoir 18 by which the fluid or ink is selectively ejected onto a medium. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

In the embodiment illustrated, head assembly 20 comprises a drop-on-demand inkjet head assembly. In one embodiment, head assembly 20 comprises a thermoresistive head assembly. In other embodiments, head assembly 20 may comprise other devices configured to selectively deliver or eject printing fluid onto a medium.

In the particular embodiment illustrated, head assembly 20 comprises a tab head assembly (THA) which includes flexible circuit 22 (shown in FIG. 2) and print head 24. Flexible circuit 22 comprises a band, panel or other structure of flexible bendable material, such as one or more polymers, supporting or containing electrical lines, wires or traces that terminate at electrical contacts 31 (shown in FIG. 2) and that are electrically connected to firing circuitry of die 24. Electrical contacts 31 extend generally orthogonal to die 32 and comprise pads configured to make electrical contact with corresponding electrical contacts of the printing device in which cartridge 16 is employed. As shown by FIG. 2, flexible circuit 22 wraps around body 22 of fluid reservoir 18. In other embodiments, flexible circuit 22 may be omitted or may have other configurations where electrical connection to firing circuitry of print head 24 is achieved in other fashions. Flexible circuit 22 includes electrical contacts which are electrically connected to corresponding electrical contacts associated with print head 24. In the example illustrated, such electrical interconnects between flexible circuit 22 and print head die 24 are encapsulated by material 31. In other embodiments, encapsulate material 31 may have other configurations or may be omitted.

Print head 24 (also known as a chip) comprises one or more structures coupled between the interior fluid chamber of the reservoir 18 configured to facilitate selected ejection or firing of droplets of fluid. Print head 24 includes die or substrate 32, thin-film layers 34, barrier layers 36 and orifice layer 38. Substrate 32 comprises a structure configured to support the remaining components of print head 24 and deliver fluid to resistors 39 (schematically shown) of thin-film layers 34. In one embodiment substrate 32 is formed from silicon. In other embodiments, substrate 32 may be formed from other materials such as one or more polymers.

Figure 5:
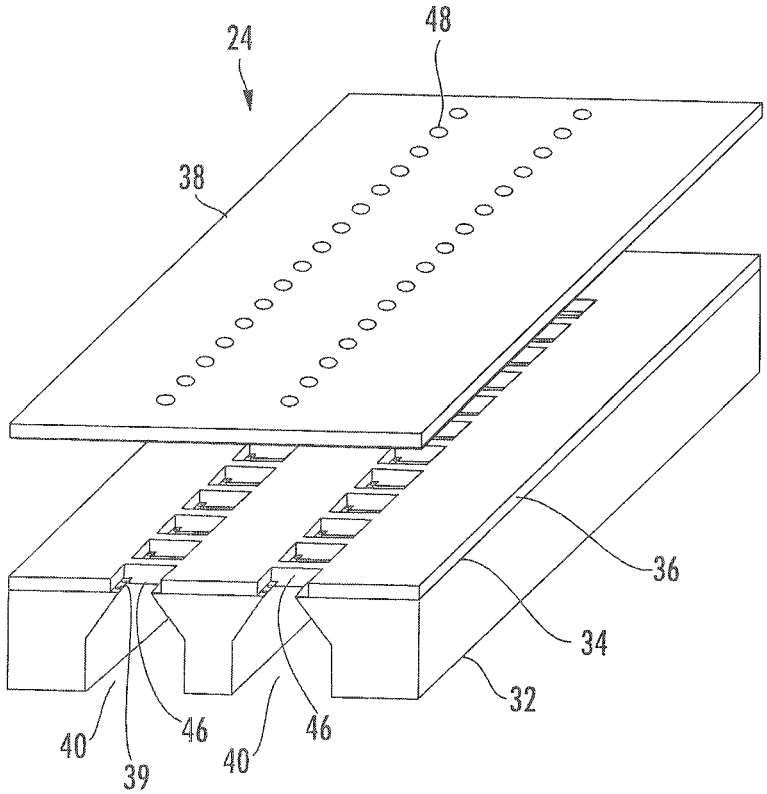
FIG. 5 is an exploded perspective view of print head of the cartridge of FIG. 2 according to an example embodiment.

As shown by FIGS. 3-5, substrate 32 includes slots 40. Slots 40 comprise fluid passages through which fluid is delivered to resistors 39. Slots 40 have a sufficient width to deliver fluid to each of resistors 39 and their associated nozzles. In one embodiment, slots 40 have a width of less than or equal to about 225 micrometers and nominally about 200 micrometers. In one embodiment, slots 40 have a centerline-to-centerline pitch of approximately 1.5 mm. In embodiments where the firing or addressing circuitry is not provided upon the chip or die 24, slots 40 may have a centerline-to-centerline pitch of approximately 0.5 mm. In other embodiments, slots 40 may have other dimensions and other relative spacings.

Thin-film layer 34 provides firing and addressing circuitry for print head 24. In particular, thin-film layer 34 comprises multiple layers having an architecture so as to form resistors 39 and their associated thin-film transistors (not shown). The thin-film transistors are used for addressing resistors 39 to selectively eject fluid. Resistors 39 are electrically connected to contact pads 31 (shown in FIG. 2) by electrically conductive lines or traces (not shown) provided by thin-film layers 34. Electrical energy supplied to resistors 39 vaporizes fluid supplied through slots 40 to form a bubble that forces or ejects surrounding or adjacent fluid through nozzles 48. In other embodiments, resistors 39 may be connected to firing or addressing circuitry located elsewhere.

Barrier layer 36 comprises one or more layers configured to at least partially form firing chambers 42 which contain resistors 39. In particular, barrier layer 36 extends about resistors 39 such that resistors 39 heat the fluid within the firing chamber 42. Barrier layer 36 spaces each resistor 42 from orifice layer 38.

As further shown by FIGS. 3 and 5, barrier layers 36 further extend the into feed slots 46 and span each of feed slots 46 at spaced locations along slot 40. Barrier layers 36 extend from and are in contact with opposite side walls of each slot 40. As a result, barrier layers 36 form a series of spaced ribs 46 within each of slots 40. Ribs 46 (also known as cross beams) comprise reinforcement structures configured to strengthen and rigidify those portions of substrate 32 between consecutive slots 40.

Because ribs 46 project into slots 40 and bear against or contact opposite side walls of slots 40, rather than simply extending above the slots 40, ribs 46 more greatly strengthen substrate 32 and rigidify substrate 32. In one embodiment, each of ribs 46 projects vertically into slot 40 by a depth of at least 2.5μ. In another embodiment, each rib 46 project into slot for 40 by a depth of at least 10μ. In another embodiment, each rib 46 project into slot for 40 by a depth of at least 20μ. In still another embodiment, each of ribs 46 projects into slot 40 by a depth of at least 40μ. In still other embodiments, ribs 46 may extend into slots 40 by other distances.

As best shown by FIG. 5, in the example illustrated, ribs 46 have a thermally symmetrical design or configuration with respect to resistors 39 of thin-film layers 34. In particular, as shown by FIG. 5, each rib 46 extends between two pairs of two resistors 39. As a result, each resistor 39 and its associated firing chamber (not shown in FIG. 5 to illustrate resistors 39) is proximate a single rib 39. Consequently, any heat conducted by ribs 46 to the fluid in the firing chambers is substantially uniformly dispersed amongst the fluid and all the firing chambers along slots 40. This uniform dispersion of heat negates or reduces any banding effects that might otherwise result from non-uniform distribution of heat by ribs 46 had such ribs 46 been non-uniformly located along slots 40 relative to the firing chambers of resistors 39.

Orifice layer 38 (also known as a nozzle layer, nozzle plate or tophat) comprises a plate or panel having a multitude of orifices which define nozzle openings 48 through which the printing fluid is ejected. Orifice plate 38 is formed, mounted or secured opposite to slots 40 and their associated firing circuitry or resistors 39. As shown by FIG. 3, orifice layer 36 is mounted to bare layers 36. As a result, ribs 46 additionally reinforce orifice layer 38, reducing the occurrences of detape fractures when tape is being removed from orifice layer 38.

In one embodiment, orifice plate 38 comprises one or more layers form from the same material as that of barrier layers 46. In one embodiment, both barrier layers 36 and orifice layer 38 are formed from a polymer. In one embodiment, layers 36 and 38 may comprise an epoxy-based photoresist. Because the polymer comprises an epoxy-based photoresist, patterning of barrier layers 36 and orifice layer 38 is facilitated. In one particular embodiment, layers 36 and 38 are formed from SU-8 commercially available from Micro Chem of Newton, Mass. In other embodiments, layers 36 and 38 may be formed from other materials. In yet other embodiments, layer 38 may be formed from a material distinct from that of layers 36. For example, in other embodiments, layer 38 may be formed from metals such as a nickel/gold layer or plate.

FIGS. 6-11 illustrate one example method for forming a print head, such as print head 24. For ease of illustration, FIGS. 6-11 illustrate the formation of a portion of print head 24 including a single feed slot. It should be understood that the remainder of print head 24 may be formed in a similar fashion with such remaining portions of print head 24 being concurrently performed with the steps shown in FIGS. 6-11.

Figure 6:
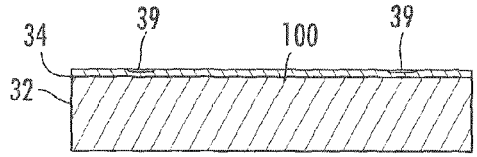
FIGS. 6, 7, 8A, 8B, 9A, 9B, 10A, 10B, 11A, 11B are sectional views illustrating the formation of the print head of FIG. 2 according to an example embodiment.

As shown by FIG. 6, thin-film layers 34 are formed upon substrate 32. As noted above, in one embodiment, substrate 32 may comprise silicon or other materials. Thin-film layers 34 comprise multiple patterned layers stacked or formed upon one so as to form resistors 39. In the example illustrated, thin-film layers further form a thin film transistor (not shown) associated with each resistor 39 and electrically conductive traces which extend to contact pads for connection to flexible circuit 22 (shown in FIG. 2). In one embodiment, thin-film layers 34 may utilize doped portions of substrate 32 for forming electrical conductors or for forming channel layers of the thin-film resistors. Examples of thin-film layers 34 may be found in U.S. Patent Publication 2003/0005883 published on Jan. 9, 2003, the full disclosure of which is hereby incorporated by reference. In other embodiments, thin-film layers 34 may have other configurations, wherein thin-film layers 34 provide resistors 39. As shown by FIG. 6, thin-film layers 34 are formed across substantially an entire upper surface 100 of substrate 32.

Figure 7:
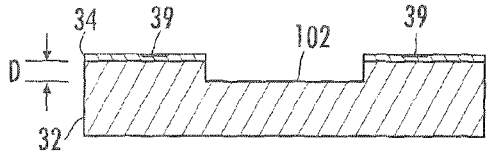

FIG. 7 illustrates formation of trench 102. In particular, FIG. 7 illustrates removal of portions of layers 34 and of substrate 32 to form trench 102. Trench 102 extends into substrate 32 by a depth D which will correspond to the height of the ribs 46 within the fluid feed slot which will be subsequently formed. In one embodiment, trench 102 as a depth D of at least 10μ. In other embodiments, trench 102 as a depth of the least about 20μ. In still another embodiment, trench 102 as a depth of the least about 40μ. As a depth of trench 102 increases, the height of the subsequently formed ribs contained within the feed slot will also increase, increasing the rigidity or strength added to substrate 32.

In one embodiment, trench 102 reformed using a dry etch to remove portions of layers 34 and substrate 32 between resistors 39. In other embodiments, other material removal techniques may be employed to form trench 102. In some embodiment, portions of layers 34 between resistors 39 may be omitted during the patterning of layers 39 upon substrate 32. In such embodiments, trench 102 may be formed by merely removing portions of substrate 32.

Figure 8A:
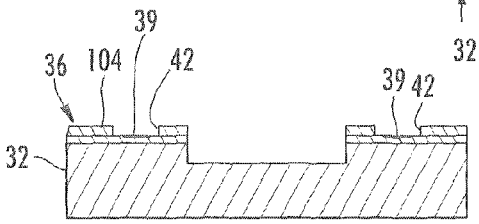
Figure 8B:
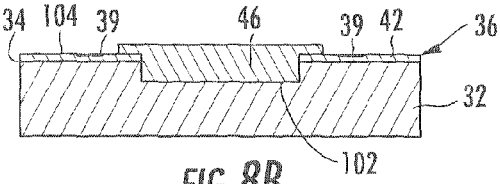

FIGS. 8A and 8B illustrate forming of a first layer 104 (sometimes referred to as a priming layer) of barrier layers 36. FIG. 8A is a sectional view taken at the first location between where ribs 46 are to be formed. FIG. 8B is a sectional view taken at a second location through where one of ribs 46 is being formed. Layer 104 serves as a base or foundation layer for barrier layers 36.

As shown by FIGS. 8A and 8B, layer 104 is selectively patterned across and over layers 34 and trench 102. In particular, as shown by FIG. 8A, locations along trench 102 where a rib 46 is not to be formed (the portion or space between consecutive ribs 46) where 104 does not fill trench 102. As shown by FIG. 8B, the location where ribs 46 is to be formed, layer 104 at least partially fills trench 102. As shown by both FIGS. 8A and 8B, layer 104 does not extend over resistors 39 such that layer 104 forms a part of the firing chambers 42 formed about resistor 39. Although not shown, in other locations, portions of layer 104 between trench 102 and resistor 39 may be omitted to form a fluid passage therebetween for the flow of fluid to resistor 39.

According to one embodiment, layer 104 comprises a polymeric photoresist. According one embodiment, layer 104 comprises an epoxy-based negative photoresist such as SU-8. In such an embodiment, layer 104 is initially spun or blanket coated over all of layers 34 and trench 102, substantially filling in trench 102. Thereafter, portions of layer 104 are selectively exposed (using an appropriate photolithography mask), developed and hard baked to form the final air 104 shown in FIGS. 8A and 8B. In other embodiments, layer 104 may be formed by methods other than photolithography.

Figure 9A:
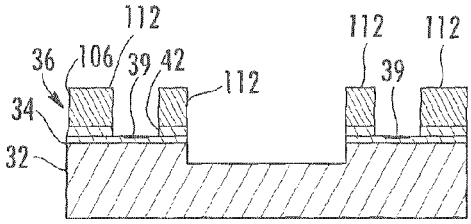
Figure 9B:
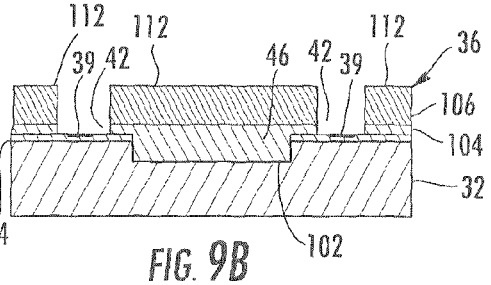

FIGS. 9A and 9B illustrate forming of a second layer 106 (sometimes referred to as a chamber layer) of barrier layers 36. FIG. 9A is a sectional view taken at the first location between where ribs 46 are to be formed. FIG. 9B is a sectional view taken at a second location through where one of ribs 46 is being formed. Layer 106 builds upon layer 104 and increase the height of firing chamber 42 about resistor 39.

As shown by FIGS. 9A and 9B, layer 106 is selectively patterned across and over layer 104. In particular, as shown by FIG. 9A, at locations along trench 102 where a rib 46 is not to be formed (the portion or space between consecutive ribs 46), layer 106 does not fill trench 102. As shown by FIG. 8B, Pat locations where ribs 46 is to be formed, layer 106 builds upon layer 104. As shown by both FIGS. 9A and 9B, layer 106 does not extend over resistors 39 such that layer 106 forms a part of the firing chambers 42 formed about resistor 39. Although not shown, at other locations, portions of layer 106 between trench 102 and resistor 39 are omitted to form a fluid passage therebetween for the flow of fluid to resistor 39.

According to one embodiment, layer 106 comprises a polymeric photoresist. According one embodiment, layer 106 comprises an epoxy-based negative photoresist such as SU-8. In such an embodiment, layer 106 is initially spun or blanket coated over all of layers 104 and trench 102. Thereafter, portions of layer 106 are selectively exposed (using an appropriate photolithography mask), developed and hard baked to form the final layer 106 shown in FIGS. 9A and 9B. In other embodiments, layer 106 may be formed by methods other than photolithography.

Figure 10A:
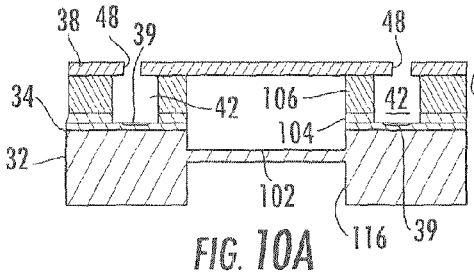
Figure 10B:
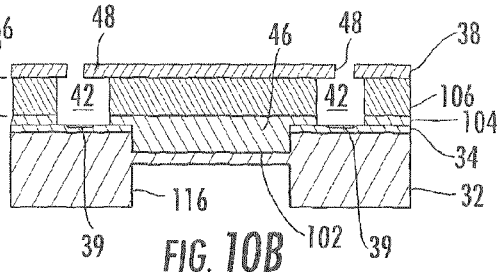

FIGS. 10A and 10B illustrate forming of orifice layer 38. Orifice layer 38 is formed such that nozzle openings 48 overlay and extend opposite to resistors 39 and firing chambers 42. As shown by FIG. 10B, orifice layer 38 stacked upon those portions of layers 104 and 106 which form rib 46. Because rib 46 extends into trench 102 and is in contact with sidewalls of trench 102, orifice layer 38 is more securely retained and reinforced by rib 46.

According to one embodiment, orifice layer 38 is formed from a polymeric photoresist. According one embodiment, layer 104 comprises an epoxy-based negative photoresist such as SU-8. In one embodiment, orifice layer 30 is formed from the same material as that of layers 104 and 106, enhancing the bonding between such layers. In other embodiments, orifice layer 38 may be formed from other materials.

According to one embodiment, orifice layer 38 is formed by first spin coating or blanket coding a filler material, such as to resist a cross and over entire top surface of the structure shown in FIGS. 8A and 8B such that all voids or recesses are filled. Thereafter, chemical mechanical planarization (CMP) is performed to polish the filler material down until the surfaces 112 (shown in FIGS. 8A and 8B) are exposed. Upon exposure of surfaces 112, a pre-form or laminate of orifice layer 38 is positioned on top of surfaces 112. Once layer 38 is positioned against surfaces 112, the supporting backing is peeled away from layer 38 and selected portions of layer 38 are patterned using photolithography to form openings 48. In particular, portions of layer 38 are selectively exposed using a mask, and developed to form openings 48. Additionally, the develop process is subsequently extended to remove the filler material through orifice openings 48 to open firing chambers 42 about resistor 39 and to open those voids between ribs 46.

In other embodiments, the formation or patterning of openings 48 may be formed using other methods. In other embodiments, the formation of openings 48 in orifice layer 38 may alternatively be formed prior to securement of layer 38 to surfaces 112 of layer 106. In still other embodiment, orifice layer 38 may be formed in other fashions or may be formed from other materials. For example, in other embodiments, orifice layer 38 may comprise metal orifice plate.

As further shown by FIGS. 10A and 10B, portions of substrate 32, beginning at side 114, are further removed to form trench 116. Trench 116 extends opposite to and is in alignment with trench 102. However, trench 116 does not extend completely through to trench 102. In one embodiment, trench 116 is formed by "hogging out" material of substrate 32 using a laser. Because trench 116 does not break through to trench 102, quicker material removal techniques, such as use of a laser, may be employed to form trench 116 without damaging layer 104 (or layers 106 or 38 if they are also in place at the time that trench 116 is formed). In other embodiments, trench 116 may be formed using other material removal techniques.

Figure 11A:
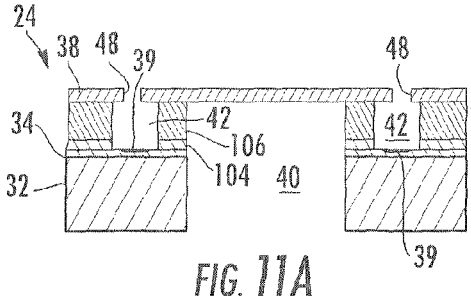
Figure 11B:
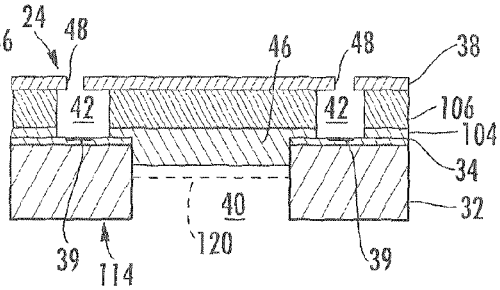

FIGS. 11A and 11B illustrate completion of fluid feed slot 40. In particular, those portions of substrate 32 between trench 102 and trench 116 or removed. In one embodiment, such portions are removed using a wet etch. In other embodiments, other material removal techniques may be employed for breaking through from trench 116 to trench 102. In embodiments where trench 116 is initially formed so as to extend to trench 102, the step shown in FIG. 11 may be omitted.

Although all of the material of substrate 32 below each rib 46 is illustrated as being removed, in other embodiments, some or all of substrate 32 below and opposite to ribs 46 may be kept. For example, in other embodiments, those portions of trench 116 opposite to ribs 46 may have a different depth as compared to other portion of trench 116 opposite to spaces between ribs 46, wherein subsequent removal or etching does not remove all of substrate 32 opposite to ribs 46. In such an embodiment, substrate 32 may itself provide cross beams or ribs 120 (shown in broken lines in FIG. 11B) below and opposite to ribs 46. In other embodiments, such ribs formed in substrate 32 may alternatively be offset or staggered along fluid feed slot 40 with respect to ribs 46, wherein the remaining passages through fluid feed slot 40 between such substrate ribs 120 and barrier layer ribs 46 is sufficiently large to permit adequate fluid flow to resistor 39.

Figure 12:
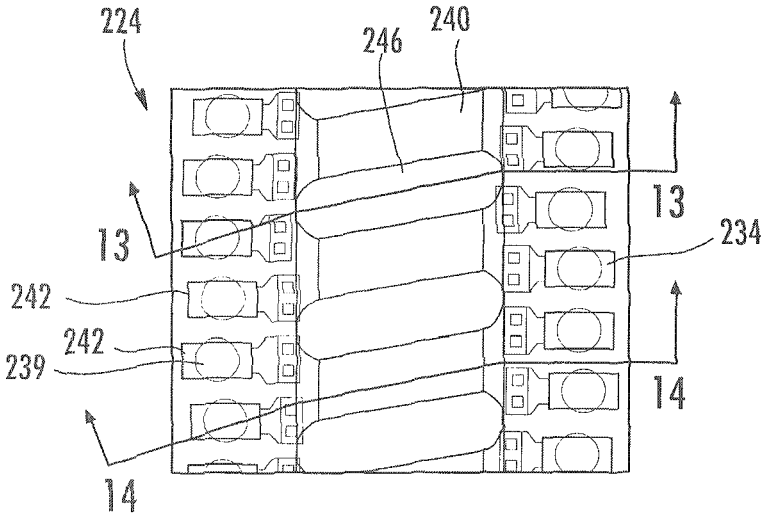
FIG. 12 is a top plan view of another embodiment of the print head of FIG. 5 according to an example embodiment.
Figure 13:
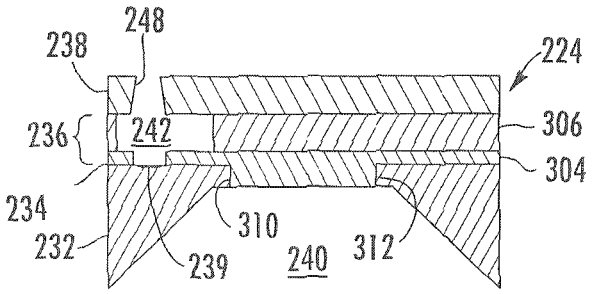
FIG. 13 is a sectional view of the print head of FIG. 12 taken along line 13-13 according to an example embodiment.
Figure 14:
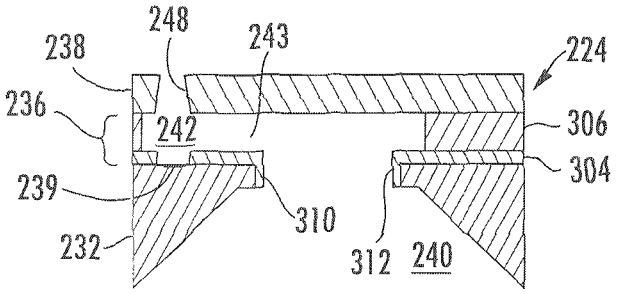
FIG. 14 is a sectional view of the print head of FIG. 12 taken along line 14-14 according to an example embodiment.
Figure 15:
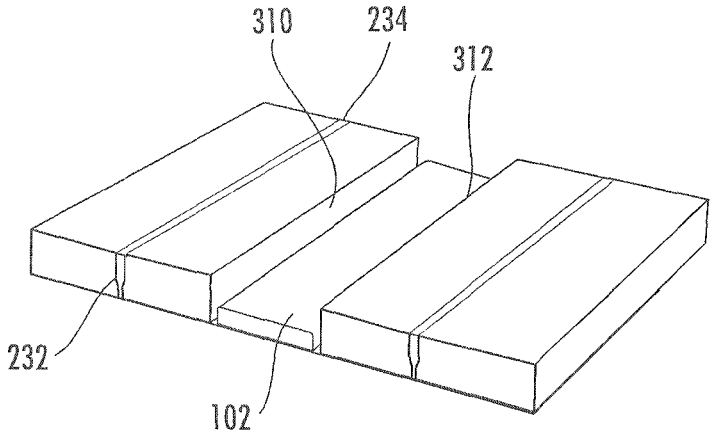
FIG. 15 is a perspective view illustrating a first stage of formation of the print head of FIG. 12 according to an example embodiment.
Figure 16:
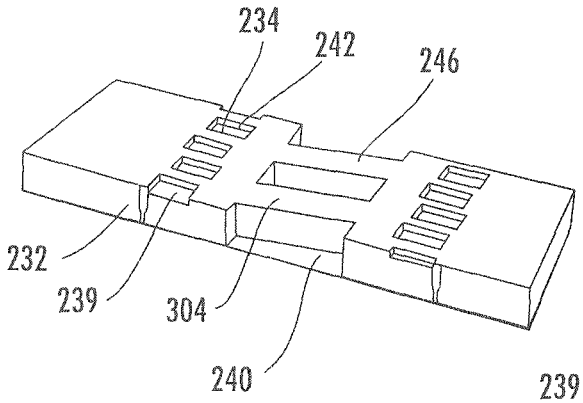
FIG. 16 is a perspective view illustrating a second stage of formation of the print head of FIG. 12 according to an example embodiment.
Figure 17:
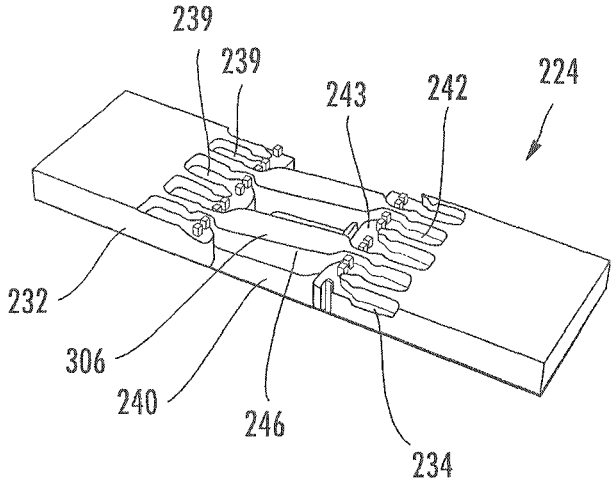
FIG. 17 is a perspective view illustrating a third stage of formation of the print head of FIG. 12 according to an example embodiment.

FIGS. 12-17 illustrate print head 224, another embodiment of print head 24 shown in FIGS. 1-5). FIGS. 12-14 illustrate a completed print head 224. FIGS. 15-17 are perspective views illustrating forming a print head 224. Similar to print head 24, print head 224 includes substrate 232, thin-film layers 234 providing resistor 239, barrier layers 236 and orifice layer 238.

Substrate 232 includes slot 240. Slot 240 comprises a fluid passage through which fluid is delivered to resistor 239. Slot 240 has a sufficient length to deliver fluid to resistor 239. In one embodiment, slots 40 have a width of less than or equal to about 225 micrometers and nominally about 200 micrometers. Although only one slot 240 is shown, print head 224 may include multiple similarly arranged slots 240 in substrate 232. In one embodiment, such multiple slots 40 have a centerline-to-centerline pitch of approximately 1.5 mm. In embodiments where the firing or addressing circuitry is not provided upon the substrate 232, slots 240 may have a centerline-to-centerline pitch of approximately 0.5 mm. In other embodiments, slots 240 may have other dimensions and other relative spacings.

Thin-film layer 234 provides firing and addressing circuitry for print head 224. In particular, thin-film layer 234 comprises multiple layers having an architecture so as to provide resistor 239 and its associated thin-film transistor (not shown). The thin-film transistor is used for addressing resistor 239 to selectively eject fluid. In particular, resistor 239 is electrically connected to contact pads 31 (shown in FIG. 2) by electrically conductive lines or traces (not shown) provided by thin-film layers 34. Electrical energy supplied to resistor 239 vaporizes fluid supplied through slots 240 to form a bubble that forces or ejects surrounding or adjacent fluid through nozzles 248. In one embodiment, resistors 239 are further connected to firing or addressing circuitry also located upon substrate 232. In another embodiment, resistor 239 may be connected to firing or addressing circuitry located elsewhere.

Barrier layer 236 comprises one or more layers configured to at least partially form firing chamber 242 adjacent to and about resistor 239. In the example illustrated in which barrier layer 236 and orifice layer 238 are formed according to the method generally described above with respect to FIGS. 6-11, barrier layers 236 includes a first priming layer 304 and a second chamber layer 306 which correspond to layers 104 and 106 described above. As shown by FIG. 13, barrier layer 236 extends about resistor 239 such that resistor 239 heats fluid within the firing chamber 242. Barrier layer 236 spaces resister 239 from orifice layer 238 and provides a fluid passage 243 from fluid feed slot 240 to firing chamber 242.

As further shown by FIG. 13, barrier layers 236 further extend the into feed slots 40 and span each of feed slots 40 at spaced locations along slot 40. Barrier layer 36 extends from and is in contact with opposite side walls 310, 312 of slot 40. As a result, barrier layer 236 forms a series of spaced ribs 246 (shown in FIG. 12) within slot 240. Ribs 246 (also known as cross beams) comprise reinforcement structures configured to strengthen and rigidify those portions of substrate 232 between consecutive slots 240 (one of which is shown).

Because ribs 246 project into slot 240 and bear against or contact opposite side walls of slot 240, rather then simply extending above the slot 240, ribs 246 more greatly strengthen substrate 232 and rigidify substrate 232. In one embodiment, each of ribs 246 project into slot 240 by a depth of at least 10μ. In another embodiment, each rib 46 projects into slot 240 by a depth of at least 20μ. In still another embodiment, each of ribs 246 projects into slot 240 by a depth of at least 40μ. In still other embodiments, ribs 46 may extend into slot 46 by other distances.

As best shown by FIG. 12, in the example illustrated, ribs 246 have a thermally symmetrical design or configuration with respect to resistors 329 of thin-film layers 234. In particular, as shown by FIG. 12, each rib 246 extends between two pairs of two resistors 239 and their associated firing chambers 242. As a result, each resistor 39 and its associated firing chamber 242 is proximate a single rib 246. Consequently, any heat conducted by ribs 246 to the fluid in the firing chambers 242 is substantially uniformly dispersed amongst the fluid and all the firing chambers along slots 240. This uniform dispersion of heat negates or reduces any banding effects that might otherwise result from non-uniform distribution of heat by ribs 246 had such ribs 246 been non-uniformly located along slots 240 relative to the firing chambers of resistors 239.

As further shown by FIG. 12, resistors 239 and their associated firing chambers 242 are offset with respect to one another along slot 240. To accommodate this offset, ribs 246 diagonally extend across and within slot 240. In other embodiments, ribs 246 may have other angles or maybe perpendicular to the axis of slot 240. Although ribs 246 are illustrated as having an approximately 50% fill ratio over slots 240, in other embodiments, ribs 246 may have other fill ratios, wherein ribs 246 have other widths.

As shown by FIG. 14, in locations between ribs 246, barrier layers 236 (priming layer 304) project into and extend along side walls 310 and 312. At such locations, barrier layers 236 serve as a protective coating over the surfaces of side walls 310, 312. As a result, during breakthrough and completion of slot 240, side walls 310 and 312 are protected from etching or material removal which may otherwise reduce the length of the shelf supporting thin-film layers 234 or weekend the shelf of substrate 232 supporting layers 234. This protective coating provided by priming layer 304 of barrier layers 236 may enable more aggressive (and faster) etching or other material removal techniques to be utilized.

Orifice layer 238 (also known as a nozzle layer, nozzle plate or top hat) comprises a plate or panel having a multitude of orifices which define nozzle openings 248 through which printing fluid is ejected. Orifice plate 38 is formed, mounted or secured opposite to slots 240 and their associated firing circuitry or resistors 239. As shown by FIG. 13, orifice layer 238 is mounted to barrier layers 36. As a result, rib 246 additionally reinforce orifice layer 238, reducing the occurrences of detape fractures when tape is being removed from orifice layer 238.

In one embodiment, orifice plate 238 comprises one or more layers form from the same material as that of barrier layers 246. In one embodiment, both barrier layers 236 and orifice layer 238 or formed from a polymer. In one embodiment, layers 236 and 238 may comprise an epoxy-based photoresist. Because the polymer comprises an epoxy-based photoresist, patterning of barrier layers 236 and orifice layer 238 is facilitated. In one particular embodiment, layers 236 and 238 are formed from SU-8 commercially available from Micro Chem of Newton, Mass. In other embodiments, layers 236 and 238 may be formed from other materials. In yet other embodiments, layer 238 may be formed from a material distinct from that of layers 236. For example, in other embodiments, layer 238 may be formed from metals such as a nickel/gold layer or plate.

FIGS. 15-17 illustrate some of the steps for forming print head 224 according to the method illustrated in FIGS. 6-11. FIG. 15 illustrates the forming a print head 224 at a stage corresponding to the stage shown in FIG. 7. In particular, FIG. 15 illustrates thin-film layers 234 formed upon substrate 232. FIG. 15 further illustrates the removal of portions of layer 234 and substrate 232 to form a trench 102 projecting into substrate 232.

FIG. 16 illustrates the forming a print head 224 at a stage corresponding to the stage shown in FIGS. 8A and 8B. In particular, FIG. 16 illustrates priming layer 304 after it has been photolithographically patterned to form a base of firing chambers 242 about resistors the role 239 and to also form a base or foundation for ribs 246 within trench 102 and in contact with side walls 310 and 312 of the subsequently fluid food feed slot 240.

FIG. 17 illustrates the forming of print head 224 at a stage corresponding to the stage shown in FIGS. 9A and 9B. In particular, FIG. 17 illustrates the addition of chamber layer 306 after chamber layer 306 has been photolithographically patterned to form a majority of a height of firing chambers 242 and fluid passages 243. Although barrier layer 236 has been illustrated and described as being formed from two layers come in other embodiments, barrier layer 236 may be formed from a single layer or more than two layers sequentially deposited and patterned.

Figure 18:
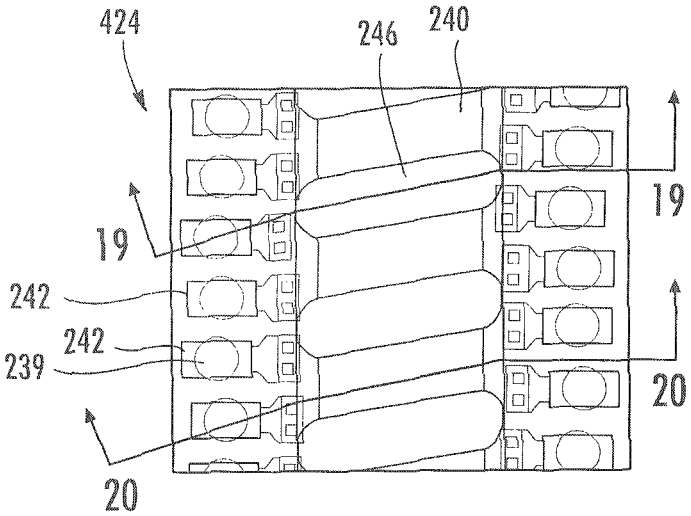
FIG. 18 is a top plan view of another embodiment of the print head of FIG. 5 according to an example embodiment.
Figure 19:
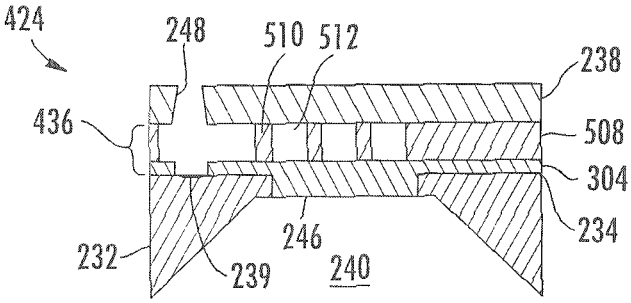
FIG. 19 is a sectional view of the print head of FIG. 18 taken along line 19-19 according to an example embodiment.
Figure 20:
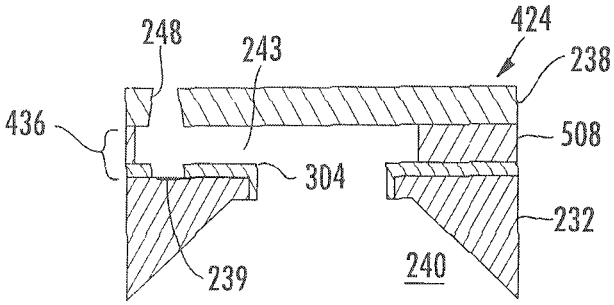
FIG. 20 is a sectional view of the print head of FIG. 18 taken along line 20-20 according to an example embodiment.

FIGS. 18-20 illustrate print head 424, another embodiment of print head 24 shown and described with respect to FIGS. 1-5. Print head 424 is similar to print head 224 (shown in FIGS. 12-14) except that print head 424 includes barrier layer 436 in place of barrier layer 336. Those remaining components are elements of print head 424 which correspond to elements are components of print head 224 are numbered similarly.

As shown by FIG. 19, barrier layer 436 is itself similar to barrier layer 236 except the bearer layer 436 includes a chamber layer 508 that includes trusses 510. Trusses 510 comprise pillars or columns extending from prime layer 304 towards and into contact with orifice layer 238. Trusses 510 are formed during the patterning of chamber layer 508 using photolithography in appropriate photolithographic masks. The trusses 510 reduce the volume of the material forming chamber layer 508 two minimize or reduce bow of the wafer having multiple print heads 424. In addition, trusses 510 former provide additional fluid flow paths 512 to enhance fluid flow. At the same time, trusses 510 maintain the stiffness or rigidity by continuing to reinforce orifice layer 238 by connecting orifice layer 238 to rib 246.

Figure 21:
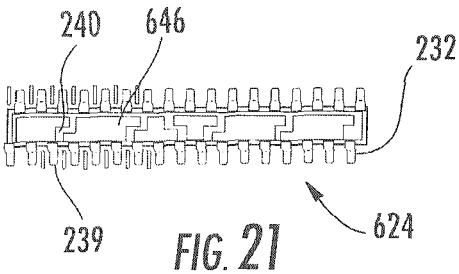
FIG. 21 is a top plan view of another embodiment of the print head of FIG. 5 according to an example embodiment.

FIG. 21 illustrates print head 624, another embodiment of print head 24 shown and described with respect to FIGS. 1-5. Print head 624 is similar to print head 224 (shown in FIGS. 12-14) except that print head 624 includes ribs 646 in place of ribs 246. Those remaining elements of print head 624 which correspond to elements of print head 224 are numbered similarly.

Like ribs 246, ribs 646 project into and extend across fluid feed slot 240. Like ribs 246, ribs 646 contact opposite side walls 310 and 312 (shown in FIG. 13) of fluid feed slot 240. Like ribs 246, ribs 646 strengthen substrate 232 and may be formed from the general method or process shown in described above with respect to FIGS. 6-11.

In contrast to ribs 246, ribs 646 non-linearly extend across and within fluids feed slot 240. In the example illustrated, ribs 646 each have portions which extend parallel to slot 240 over a center of slot 240. Such stepped portions of ribs 646 are stepped in opposite directions along slot 240. Ribs 646 strengthen portions of substrate 232 proximate to ends of slot 240. In other embodiments, ribs 646 may have other non-linear configurations across slot 240.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible.

For example, unless specifically otherwise noted, the claims reciting a single particular element also encompass a plurality of such particular elements.

What is claimed is:

1. A print head comprising:

a substrate including a fluid feed slot (40, 240) having opposing side walls; and a first layer (36, 236) on the substrate at least partially forming fluid firing chambers, the layer forming ribs in contact with each of the opposing side walls and extending from a first one of the side walls to a second one of the side walls within the fluid feed slot.

2. The print head of claim 1, wherein the first layer comprises an epoxy based photoresist.

3. The print head of claim 2, wherein the first layer comprises SU-8 photoresist.

4. The print head of claim 1 further comprising:

a second layer spaced from the ribs; and trusses extending between the ribs and the second layer.

5. The print head of claim 1, wherein the layer extends into the fluid feed slot by a depth at least about 10μ.

6. The print head of claim 1, wherein the layer extends into the fluid feed slot by a depth at least about 20μ.

7. The print head of claim 1, wherein the layer extends into the fluid feed slot by a depth at least about 40μ.

8. The print head of claim 1, wherein each of the firing chambers is proximate a single one of the ribs.

9. The print head of claim 1, wherein the ribs only extend across and within the feed slot.

10. The print head of claim 1, wherein the fluid firing chambers includes a first set of firing chambers on a first side of the fluid feed slot and a second set of firing chambers on a second opposite side of the fluid feed slot, the second set of firing chambers being offset in a direction along the fluid feed slot from the first set of firing chambers, wherein the ribs only extend across and within the fluid feed slot.

11. The print head of claim 1 further comprising an orifice layer over the firing chambers, where the orifice layer is connected to and in contact with the ribs.

12. The print head of claim 11, wherein the first layer and the orifice layer are formed from a same material.

13. The print head of claim 12, wherein the first layer and orifice layer are formed from an epoxy based photoresist material.

14. The print head of claim 1, wherein the first layer comprises a photoresist material and wherein the print head further comprises thin-film layers forming transistors electrically connected to resistors adjacent the firing chambers.

15. The print head of claim 14, wherein the first layer has a thickness of the least about 2.5μ and over lies the thin film layers.

16. The print head of claim 1, wherein the ribs nonlinearly extend across the fluid feed slot within the fluid feed slot.

17. A method comprising:

forming a first layer on a substrate, the first layer at least partially forming fluid firing chambers on the substrate and ribs in contact with opposing side walls of a fluid feed slot while extending from a first side wall to a second opposite side wall within the fluid feed slot.

18. The method of claim 17 further comprising:

forming a first trench into a first side of the substrate;

forming the first layer in the first trench; and removing portions of the substrate between the first trench and a second opposite side of the substrate to form a slot through the substrate, wherein portions of the first layer form the ribs extending across and within a fluid feed slot.

19. The method of claim 17, wherein the ribs extend diagonally across the fluid feed slot.

20. The method of claim 17, wherein the first layer extends into the fluid feed slot by a depth of at least about 10μ.

* * * * *

UNITED STATES PATENT AND TRADEMARK OFFICE

CERTIFICATE OF CORRECTION

PATENT NO. : 8,733,902 B2
APPLICATION NO. : 12/934708
DATED : May 27, 2014
INVENTOR(S) : Bradley D. Chung et al.

It is certified that error appears in the above-identified patent and that said Letters Patent is hereby corrected as shown below:

On the Title page, in item (54) and in the Specification, in column 1, line 1, Title, delete "PRINTHEAD" and insert -- PRINT HEAD --, therefor.

In the Claims:

In column 11, line 6, in Claim 1, after "slot" delete "(40, 240)".

In column 11, line 8, in Claim 1, after "layer" delete "(36, 236)".

Signed and Sealed this
Twenty-first Day of April, 2015

Michelle K. Lee

Michelle K. Lee
*Director of the United States Patent and Trademark Office*